US009105955B2

(12) United States Patent
Puoskari et al.

(10) Patent No.: US 9,105,955 B2
(45) Date of Patent: Aug. 11, 2015

(54) ADJUSTABLE RESONATOR FILTER AND METHOD FOR ADJUSTING COUPLING BETWEEN RESONATOR CAVITIES

(75) Inventors: Jukka Puoskari, Tupos (FI); Petri Päri, Kempele (FI)

(73) Assignee: Intel Corporation, Santa Clara, CA (US)

( * ) Notice: Subject to any disclaimer, the term of this patent is extended or adjusted under 35 U.S.C. 154(b) by 428 days.

(21) Appl. No.: 13/523,623

(22) Filed: Jun. 14, 2012

(65) Prior Publication Data

US 2013/0009728 A1 Jan. 10, 2013

(30) Foreign Application Priority Data

Jul. 6, 2011 (FI) ..... 20115721

(51) Int. Cl.
*H01P 1/205* (2006.01)
*H01P 7/04* (2006.01)

(52) U.S. Cl.
CPC ..... *H01P 1/2053* (2013.01); *H01P 7/04* (2013.01)

(58) Field of Classification Search
CPC ..... H01P 1/2084; H01P 1/2053; H01P 1/202; H01P 1/2056; H01P 7/04; H01P 7/06; H01P 7/10
USPC ..... 333/202, 203, 219.1, 227, 231, 232, 333/233, 206, 207, 222, 223
See application file for complete search history.

(56) References Cited

U.S. PATENT DOCUMENTS 3,693,115 A 9/1972 Edson
4,307,357 A 12/1981 Alm
5,764,115 A * 6/1998 Hattori et al. ..... 333/202
5,805,033 A 9/1998 Liang et al.
2004/0108919 A1 6/2004 Snyder

FOREIGN PATENT DOCUMENTS

EP 0759645 A2 2/1997
EP 1321997 A2 6/2003
EP 1895615 A1 3/2008
WO 01/84662 A1 11/2001
WO 2004/084340 A1 9/2004
WO 2010147418 A2 12/2010

OTHER PUBLICATIONS

European Search Report dated Sep. 26, 2012 from application No. 12171289.7, 6 pages.
Finland Search Report for Application No. 20115721 dated Nov. 28, 2011.

* cited by examiner

*Primary Examiner* — Benny Lee
*Assistant Examiner* — Jorge Salazar, Jr.
(74) *Attorney, Agent, or Firm* — Schwegman Lundberg & Woessner, P.A.

(57) ABSTRACT

The invention relates to an adjustable resonator filter, which has a casing made up of a bottom, walls and a lid, which casing functions as a ground for a transmission path, which is divided with conductive partitions into resonator cavities, and on the transmission path of the resonator filter there is a coupling opening in the partitions separating subsequent cavities. In the casing there is by at least one partition a coupling space, which is open into both resonator cavities separated by the partition, which resonator filter has an inductive coupling member. This is arranged to extend through said coupling space into both resonator cavities. The inductive coupling member is in electric contact with the casing at least in one of the resonator cavities. In the coupling space there is a moveable conductive adjustment piece, which has a minimum position for the coupling and a maximum position for the coupling.

11 Claims, 3 Drawing Sheets

ADJUSTABLE RESONATOR FILTER AND METHOD FOR ADJUSTING COUPLING BETWEEN RESONATOR CAVITIES

The present application claims priority to foreign application FN-20115721 of Finland filed on Jul. 6, 2011.

BACKGROUND OF THE INVENTION

1. Field of the Invention

The invention relates to an adjustable resonator filter, which has a casing made up of a bottom, walls and a lid, which casing functions as a ground for a transmission path, which is divided with conductive partitions into resonator cavities, and on the transmission path of the resonator filter there is a coupling opening in the partitions separating subsequent cavities. The invention further relates to a method for adjusting the coupling between resonator cavities.

2. Background of the Prior Art and Related Information

Cavity resonators are generally used in communications networks for making filters, especially when the effect of the signal to be transferred is relatively large. This is due to the fact that losses caused by such resonator filters are small, which means only a slight attenuation of the efficiency signal. Additionally their response characteristics are easy to control and adjust even according to strict specifications.

Common radio-frequency resonators are various cavity and coaxial resonators, because they can be used to build filters, which have small losses and withstand relatively large capacities. The basic structure of the resonator comprises an internal conductor, an external conductor comprising of the side walls, a bottom and a lid. The bottom and the lid are in galvanic contact with the external conductor, and all three together form a closed resonator casing. Usually the lower end of the internal conductor is galvanically connected to the bottom and the upper end is in the air, whereby the transmission path formed by the resonator is short-circuited in its lower end and open in its upper end. The filter usually has two or more resonators coupled together.

In most filters, both the location and width of the pass band of the filter is meant to be fixed. In some filters the width of the pass band of the filter is meant to be constant, but the location of the pass band must be possible to select from within a certain total area. Thus an adjustment possibility for moving the pass band is needed in the filter in addition to the basic rigging. In order for the frequency response of the band pass filter to be according to requirements, the pass band thereof must on the one hand be in the right place on the frequency axis and on the other hand have the right width. In a resonator filter this requires that, on the one hand, the specific frequency of each resonator is correct and, on the other hand, the strength of the couplings between resonators is correct.

The width of the pass band is adjusted by altering the strength of the coupling between the resonators and at the inlet and outlet of the filter. The adjustment of the band width is based on arranging a so-called cross coupling between subsequent resonators with the same specific frequency, whereby they have a double resonance. When the coupling is thus further strengthened, the resonance peaks of the double resonance draw away from each other, which naturally has a widening effect on the band. At the production stage the band pass filter is in principle dimensioned so that the strength of the coupling between the middle resonators is the smallest and when moving from the middle toward the ends of the filter the strength of the coupling between the resonators grows.

When all couplings are strengthened evenly, the band of the filter widens while the attenuation variation remains small in the pass band.

The adjustment of the strength of the coupling, or shorter the adjustment of the coupling, can be realized in several ways. One way is to equip the structure with metallic screws, so that these extend through the lid of the filter to the coupling openings between the resonators. When turning such a screw for example deeper into the coupling opening, the coupling between the resonators in question grows, which has a widening effect on the band. A disadvantage with using tuning screws is that the boundary surface between them and the surrounding metal can cause harmful passive intermodulation when using the filter. Additionally the electric contact in the threads can deteriorate over time, which causes changes in the tuning and an increase in losses in the resonator.

The coupling between two resonators can also be adjusted by means of a bendable tuning member arranged close to the coupling opening. A disadvantage with such a solution is that in a multi-resonator filter the tuning members may need to be bent in several stages to achieve the desired frequency response. The lid of the filter must be opened and closed with each adjustment, wherefore the tuning takes time and is relatively expensive.

Patent publication U.S. Pat. No. 5,805,033 presents a known manner of adjusting the coupling between resonators of a filter. The filter has a casing made up of a bottom, outer walls and a lid, the space of which casing is divided with conductive partitions into resonator cavities. In order to realize the coupling between the resonators there is an opening in their partition, which extends from the lid to the bottom and which narrows toward the bottom. There is a tuning member in the coupling opening for adjusting the coupling, which tuning member is a circular metal plate parallel to the lid. This is attached to the lid by means of a screw bar extending outside of the filter casing. The above-mentioned problems arise in such an arrangement. With such an arrangement the adjustment area does not necessarily turn out linear.

SUMMARY OF THE INVENTION

An object of the invention is a solution by which the drawbacks and disadvantages relating to the prior art can be considerably reduced.

One aspect of the invention is to adjust the coupling between two subsequent resonator cavities by forming an adjustment arrangement, which has a coupling space between two resonator cavities, in which space there is an inductive coupling member, the load of which is adjusted simultaneously with the coupling between the resonator cavities by moving the adjustment member in relation to the coupling member. The adjustment member advantageously remains in the coupling space, whereby it affects the resonators as little as possible.

An adjustable resonator filter according to one embodiment of the invention has a casing made up of a bottom, walls and a lid, which casing functions as a ground for a transmission path, which is divided with conductive partitions into resonator cavities, and on the transmission path of the resonator filter there is a coupling opening in the partitions separating subsequent cavities. According to one advantageous embodiment of the invention the casing has a coupling space by at least one partition, which space is open into both resonator cavities separated by the partition. The resonator filter has at least one inductive coupling member, which is arranged to extend through the coupling space into both resonator cavities, and the inductive coupling member is in electric contact with the casing at least in one of the resonator cavities. In the coupling space there is a moveable conductive adjustment piece, which has a minimum position for the coupling and a maximum position for the coupling. In the maximum position for the coupling the adjustment piece is in the immediate vicinity of the inductive coupling member, loading the inductive coupling member via the capacitive coupling, and in the minimum position of the coupling the adjustment piece is apart from the inductive coupling member. The adjustment piece is in the positions and in its path outside them at least partly outside the resonator cavities or in the area of the resonator cavities, where the electric and magnetic field are substantially at their minimum.

In one advantageous embodiment of the resonator according to the invention the coupling space is in the wall of the casing and extends substantially from the bottom to the lid.

In a second embodiment of the resonator according to the invention the inductive coupling member has a first end and a second end and it is by its first end attached to the wall of the resonator cavity and its second end is in the second resonator cavity.

In a third embodiment of the resonator according to the invention the second end of the inductive coupling member is detached from the wall of the resonator cavity.

In a fourth embodiment of the resonator according to the invention the inductive coupling member is substantially electrically separated from the walls of the coupling space, i.e. thus it does not have substantial electric contacts with the walls of the coupling space.

In a fifth embodiment of the resonator according to the invention the inductive coupling member has a protruding part between its first and second end, in its part in the coupling space, close to which protruding part the adjustment piece is arranged in the maximum position for the coupling.

In a sixth embodiment of the resonator according to the invention the shape of the protruding part is substantially the same as the shape of at least some part close to the inductive coupling member of the part of the adjustment piece.

In a seventh embodiment of the resonator according to the invention the adjustment piece has a maneuvering arrangement, by means of which the location of the adjustment piece can be altered from outside the resonator filter. In an eighth embodiment of the resonator according to the invention the maneuvering arrangement is arranged to move several adjustment pieces simultaneously.

In an eighth embodiment of the resonator according to the invention the adjustment piece is arranged to be moved substantially in the longitudinal direction of the filter, i.e. in the direction of the subsequent resonator cavities.

In a ninth embodiment of the resonator according to the invention the adjustment piece is substantially on top of the same spot on the inductive coupling piece and the distance from the adjustment piece to the inductive coupling piece is arranged to be adjustable.

In a method according to the invention for adjusting the coupling between resonator cavities, the resonator cavities have a wall, which is comprised of a bottom, a wall and a lid and a conductive partition separating adjacent resonator cavities. The partition separating subsequent cavities has a coupling opening. According to an advantageous embodiment of the method according to the invention a coupling space is formed in the partition in the wall of two resonator cavities, which coupling space is open into both resonator cavities separated by the partition. Between these resonator cavities there is an inductive coupling member, which is arranged to extend through the coupling space into both resonator cavities. The inductive coupling member is in electric contact with the casing at least in one of the resonator cavities. In the coupling space there is a moveable conductive adjustment piece, which has at least one minimum position for the coupling and maximum position for the coupling. In the method the adjustment piece is moved between the minimum position for the coupling and the maximum position for the coupling, whereby in the maximum position the adjustment piece is close to the inductive coupling member and loads it via the capacitive coupling and simultaneously increases the strength of the coupling between the resonator cavities, and in the minimum position the adjustment piece is apart from the coupling member and its effect on the coupling between the resonator cavities is at its minimum. The adjustment piece is set in either the position or in some other spot on the path of the adjustment piece in order to obtain the desired strength of the coupling.

It is an advantage of the invention that it can easily be adapted to different resonator filter types and it is structurally simple. The adjustment parts can additionally be made of metal. These make possible a decrease in the production costs.

It is further an advantage of the invention that the adjustment piece is far from the conductors of the resonators, whereby effects on the properties of the resonators are slight with the arrangement according to the invention.

It is also an advantage of the invention that a large and linear adjustment area is easily obtained with the arrangement in accordance thereto. The arrangement according to the invention is also easy to automate.

Further by means of the invention the adjustment of the filter can be done from outside the resonance cavities.

Further aspects of the invention are described in the following detailed description.

BRIEF DESCRIPTION OF THE DRAWINGS

In the following, the invention will be described in detail. In the description, reference is made to the appended drawings, in which.

DETAILED DESCRIPTION OF THE INVENTION

Figure 1:
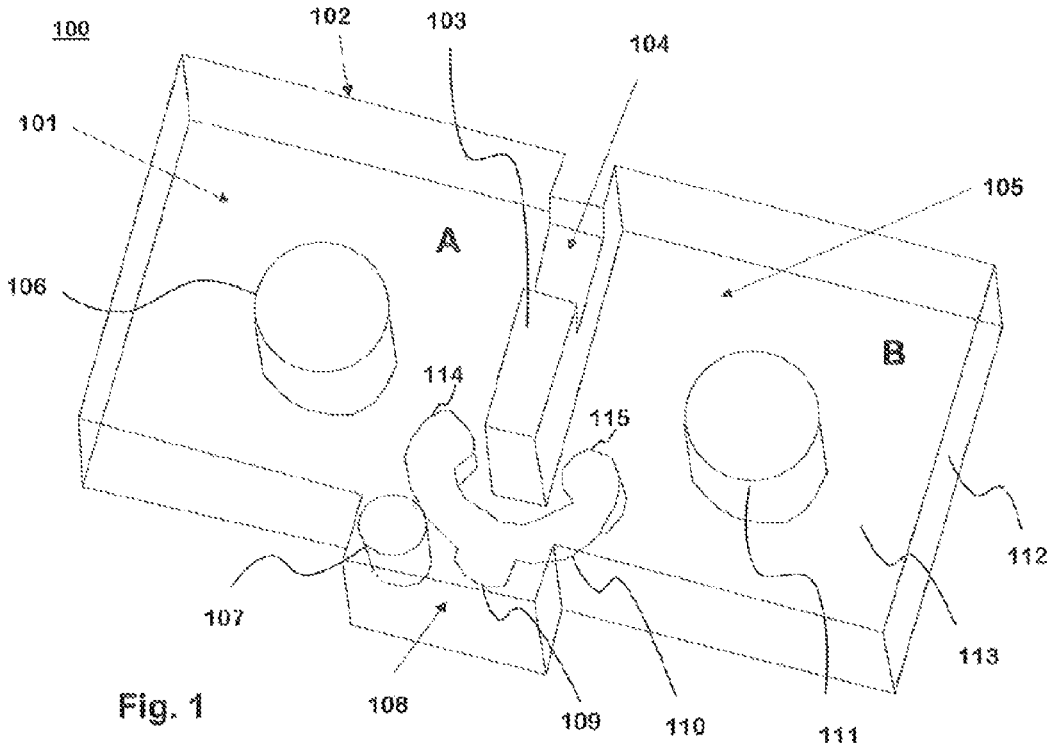
FIG. 1 shows an example of a resonator filter according to the invention seen from above.

FIG. 1 shows a simplified example of a resonator filter 100 according to the invention as a perspective drawing. The filter has a conductive casing, the shell 102 of which is made up of a bottom 113, walls 112 and a lid. In the figure the lid is removed for illustrative purposes and the walls are partly transparent. The filter has two resonators, a first resonator A and a second resonator B, which are separated by a partition 103. The partition has a coupling opening 104. The first resonator has a first resonator cavity 101 and a first internal conductor 106 of the resonator, which conductor is by its lower end connected to the bottom in a galvanic manner and the upper end of which is in the air. The second resonator correspondingly has a second resonator cavity 105 and a second internal conductor 111 of the resonator. The sides of the resonator cavities are substantially shaped like parallelograms.

In the shell of the casing of the resonator filter 100 there is a coupling space 108. This is formed by the partition 103, so that the coupling space opens into the first resonator cavity 101 and the second resonator cavity 105 separated by the partition. The coupling space is advantageously placed so that it is as far away as possible from the internal conductors of the resonators. In the case shown in the figure it is placed in the wall of the shell by the end of the partition where the distance to the coupling opening 104 is greater. This applies in a case where the coupling opening is located asymmetrically. By placing the coupling space as far away as possible from the coupling opening, disturbances caused by the members placed in the coupling space and a tuning member possibly located in the coupling opening to each other are avoided. The coupling space is in the case according to the example formed by making a recess in the wall, which recess extends from the bottom of the shell to the lid. The bottom of the coupling space is thus the bottom of the filter and the upper surface of the coupling space is the lid of the filter. The size of the coupling space is further increased by shortening the partition, so that it no longer is as long as the width of the resonator cavity. In some embodiments the partition can be continued so that it extends into the recess of the coupling space formed in the wall. Thus the coupling space would be a passage-like structure, which has a curve. The coupling space can be placed also elsewhere in the shell than in the wall. Additionally it can also extend into different parts of the shell. For example in the example according to the figure, the coupling space can extend upward into the lid. Thus the coupling space can be higher than the height of the resonator cavity.

The resonator filter 100 has an inductive coupling member 110 between the first resonator A and the second resonator B. The inductive coupling member is conductive and it is used to form an inductive coupling between the resonators. The strength of the coupling is proportional to the electric properties of the inductive coupling member. The coupling member has a first end 114 and a second end 115. The coupling member is attached by its first end to the bottom of the resonator cavity 101 of the resonator A with a support part. The support part is made of a conductive material. The support part keeps the coupling element apart from the bottom. In the case according to the example the coupling member is a curved plate, in the midpoint of which there is a protrusion 109. The protrusion can also be in some other spot on the coupling member, but it is advantageously in the part of the coupling member, which is in the coupling space. The protrusion can be made for example by shaping the coupling member for example by bending or stretching. The protrusion can also be attached to the coupling member in some known manner. The coupling member is placed in the resonator filter so that its midpoint is in the coupling space 108. In other words the first end of the coupling member is in the first resonator cavity and the second end of the coupling member in the second resonator cavity 105. There is an induction piece in the second end of the coupling member. The coupling member is thus in contact with the shell only by its first end. The coupling member can also be manufactured from one part, whereby the first end of the coupling member is a support part and the second end is an induction piece.

In the coupling space 108 there is an adjustment piece 107. The adjustment piece is made from a conductive or a dielectric material and it is moveable. In the case according to the figure the adjustment piece has a maneuvering arrangement, which extends through the lid. The adjustment piece is insulated from the maneuvering arrangement or the maneuvering arrangement is insulated from the lid. One embodiment is a screw penetrating the lid, which screw has a plastic protective sleeve. The protective sleeve travels in a gap in the lid, which gap determines the path, which the adjustment piece can travel. The adjustment piece is not in contact with the shell 102 of the casing of the resonator filter 100. In the case according to the figure the adjustment piece is a cylindrical piece, which is moveable in the coupling space in a direction, which is substantially transverse to the partition 103. The lower surface of the cylinder is toward the bottom of the filter and the upper surface is toward the lid. The bottom of the adjustment piece, i.e. the lower surface of said cylinder, is above the upper surface of the coupling member 110.

The adjustment piece 107 has at least one minimum position for the coupling and maximum position for the coupling, and the adjustment piece can be moved at least between these positions. In the minimum position for the coupling the adjustment piece is as far away as possible from the coupling member 110. Thus the electric effect of the adjustment piece on the coupling member is at its minimum. In the maximum position for the coupling the adjustment piece is on top of the coupling member and advantageously the protrusion 109 of the coupling member and the electric effect of the adjustment piece on the coupling member is at its maximum. When the adjustment piece is in the minimum position for the coupling, the coupling between the resonators caused by the inductive coupling member is at its minimum and its effect on the bandwidth of the filter is at its minimum. In the maximum position for the coupling the coupling between the resonators is at its maximum and its effect on the bandwidth of the filter is at its maximum. The bandwidth of the filter can be affected also in other ways simultaneously with the arrangement according to the invention. When the adjustment piece moves onto the coupling member, a capacitive coupling is generated between them. The adjustment piece and the coupling member are thus not in contact with each other. The adjustment piece alters the electric properties of the inductive coupling member and simultaneously the inductive coupling between the resonators. The movement of the adjustment piece onto the coupling member can be compared to a situation, where a capacitor would be connected to the coupling member, the surface area and simultaneously the capacitance of which capacitor can be adjusted. The bottom of the adjustment piece and the protrusion of the coupling member or the part thereof, onto which the adjustment piece is arranged to come, can have been shaped to correspond to each other, so that the surface area of the capacitive connection could be made larger than with a smooth surface. These could be wave or serrated forms. In this example the adjustment piece moves substantially in the direction of the surface of the adjustment piece, but the adjustment piece can in some cases also be moved vertically, so that its bottom is substantially in the same spot above the coupling member and its distance from the surface of the coupling member is adjusted. Although in this example the adjustment piece is above the coupling member, i.e. between the surface of the coupling member and the lid of the filter, the adjustment piece can also be placed below the coupling member, i.e. between the coupling member and the bottom of the filter or between the coupling member and the wall of the coupling space. The distances of the adjustment piece to the surfaces of the shell of the filter, such as for example the bottom and the lid, remain substantially constant when moving the filter piece, whereby changes in the load of the coupling member and simultaneously changes in the coupling remain linear. By selecting the size and electric properties of the adjustment piece, the adjustment tolerance of the bandwidth of the filter can be changed.

The adjustment piece 107 is advantageously in every part of its path at least partly in the coupling space 108. If the adjustment piece must, for example in the minimum position for the coupling in order to get it as far away as possible from the inductive coupling member 110, be moved completely or partly into the resonator cavity, a place is selected in the resonator cavity, where the electric and magnetic fields are at their minimum, whereby the adjustment piece affects the operation of the resonator as little as possible.

Figure 2:
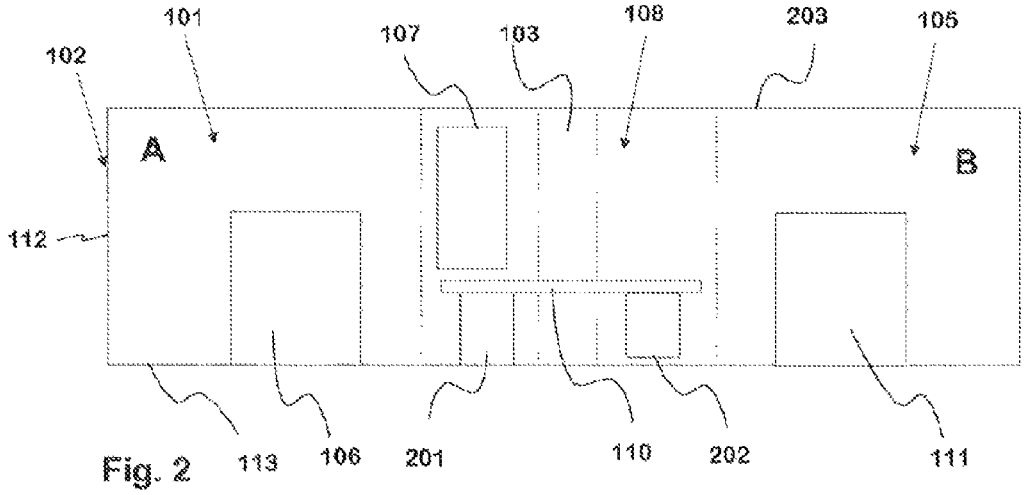
FIG. 2 shows the resonator filter of FIG. 1 as a side cross-section.

FIG. 2 shows a side cross-section of the resonator filter of FIG. 1. The shell 102 of the filter is made up of a bottom 113, walls 112 and a lid 203. The first resonator A and the second resonator B are separated by a partition 103. Between the resonators in the wall of the shell there is a coupling space 108, which is open into the first resonator cavity 101 and the second resonator cavity 105. The partition and the coupling space are marked with a dotted line in the figure. An inductive coupling piece 110 is attached by its first end to the bottom of the first resonator cavity with a support piece 201. The support piece is made of a conductive material. The coupling piece extends through the coupling space into the second resonator cavity, where there is an induction piece 202 in the second end of the coupling piece. The induction piece is not in contact with the walls of the second resonator cavity. The induction piece is made of a conductive material. The support piece, the coupling piece and the induction piece are advantageously made of the same material. Even though the induction piece is in the example according to the figure placed so that it comes close to the bottom of the resonator cavity, it can also be placed in some other manner. The induction piece is in all cases not necessarily needed, it is enough that the coupling piece reaches the second resonator cavity. In some cases the coupling piece can have several support pieces, some of which may be in the coupling space. In the coupling space there is additionally an adjustment piece 107. The adjustment piece is placed so that it can be moved close to the coupling piece in the coupling space.

Figure 3:
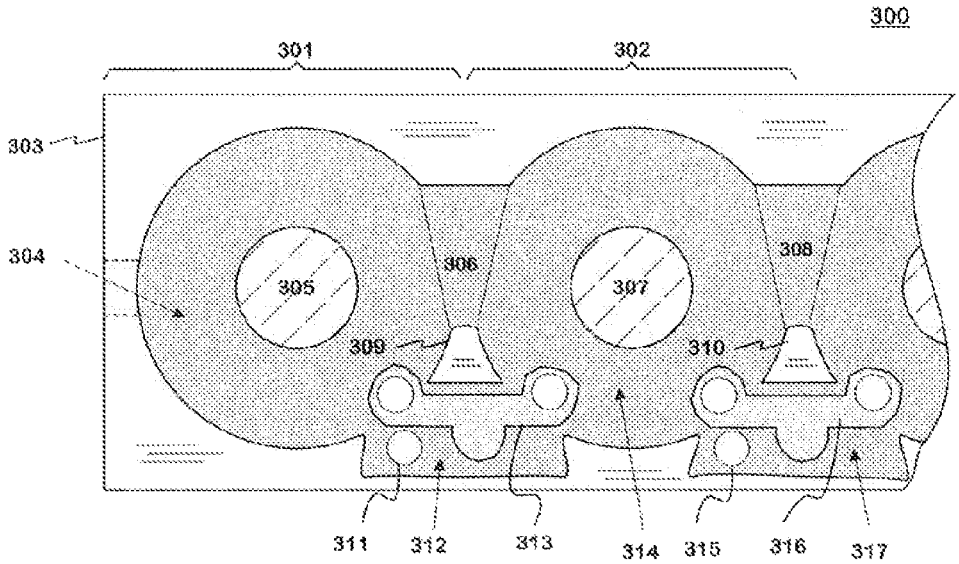
FIG. 3 shows a second example of a resonator filter according to the invention seen from above, FIGS. 4(*a*), 4(*b*) and 4(*c*) show examples of the different stages of the adjustment of a resonator filter according to the invention.

FIG. 3 shows a second example of the resonator filter 300. The resonator filter has a casing 303 and several resonators. The figure shows a first resonator 301 and a second resonator 302. The first resonator has a first internal conductor 305 and a first resonator cavity 304. The second resonator has a second internal conductor 307 and a second resonator cavity 314. Adjacent resonators are separated by partitions. In the figure the first resonator and the second resonator are separated by a first partition 309 and the second and third resonator (partly shown in the figure) are separated by a second partition 310. In the case according to the example the resonators and the internal conductors of the resonator are cylindrical. The partitions have coupling openings connecting the resonator cavities. The first partition has a first coupling opening 306 and the second partition has a second coupling opening 308. In the wall of the filter casing there is by the partition a coupling space, which is open into both adjacent resonator cavities. The resonators are through the coupling space connected by an inductive coupling member. By the first partition there is a first coupling space 312 and by the second partition there is a second coupling space 317. The first coupling space has a first coupling member 313 and the second coupling space has a second coupling member 316. The coupling between the first and second resonator formed by the first coupling member is altered with a first adjustment piece 311 in the first coupling space and correspondingly the coupling between the second and third resonator is altered with a second adjustment piece 315. For the operation and adjustment of the resonators and the filters formed by them it is advantageous that the adjustment piece disturbs the operation of the resonator as little as possible. In the example according to the figure the side walls of the coupling spaces form an angle with the end wall of the coupling space, i.e. with the wall in the direction of the wall of the filter casing, which angle is smaller than a right angle. Thus the wall of the resonator cavity and the side wall of the coupling space form a pocket-like structure, into which the adjustment piece can be moved in the minimum position for the coupling. When in this pocket-like structure, the adjustment piece affects the operation and properties of the resonator and coupling member as little as possible.

Figure 4:
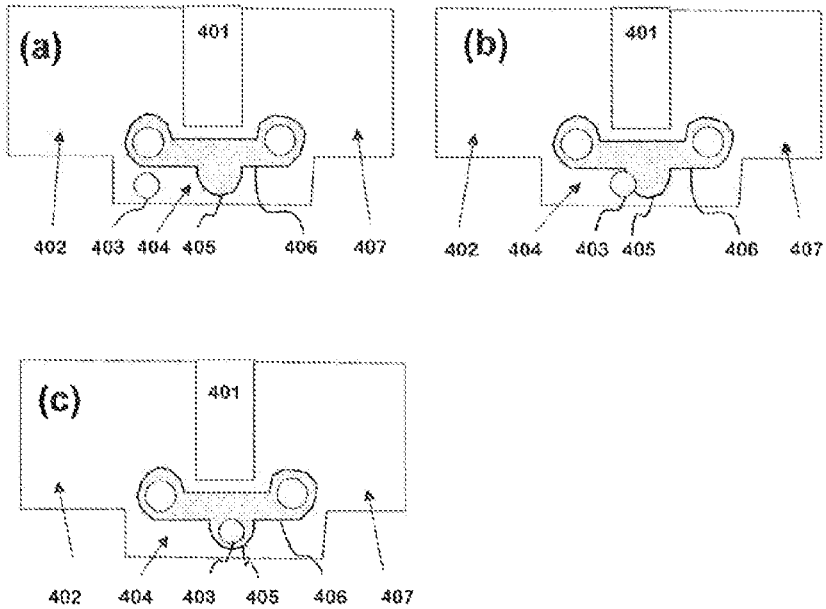

FIGS. 4(*a*), 4(*b*) and 4(*c*) show examples of the different stages of the adjustment of a resonator filter according to the invention. The figures are simplified for illustrative purposes. The figure shows a first resonator cavity 402, a second resonator cavity 407, a partition 401 separating the cavities, a coupling space 404 in the filter wall by the partition, a moveable adjustment piece 403 in the coupling space and an inductive coupling member 406 connecting the resonator cavities. The coupling member is in contact with the bottom of the first resonator cavity and it extends through the coupling space into the second resonator cavity. The coupling member has a protrusion 405 substantially in its midpoint. In FIG. 4*a* the adjustment piece is in the minimum position for the coupling and it is clearly apart from the coupling member. By shaping the coupling member and by selecting its attaching point in the resonator cavity to be farther from the coupling space than what is shown in FIG. 4(*a*), the coupling member can when necessary be placed farther from the adjustment piece, when it is in the minimum position for coupling. In FIG. 4*b* the adjustment piece is moved toward the protrusion. Thus the coupling caused by the coupling member between the resonators is strengthened. In FIG. 4*c* the adjustment piece is in the maximum position for the coupling, i.e. it is completely on top of the coupling member. Thus the load caused by the adjustment piece on the coupling member is at its maximum and the strength of the coupling between the resonators caused by the coupling member is as its maximum. The adjustment piece can be arranged to move also over the protrusion of the coupling member to the opposite side than where the adjustment piece was in FIG. 4*a*. In some cases the coupling member can be made asymmetrical. Several protrusions of different shapes can also be arranged in the coupling member.

Figure 5:
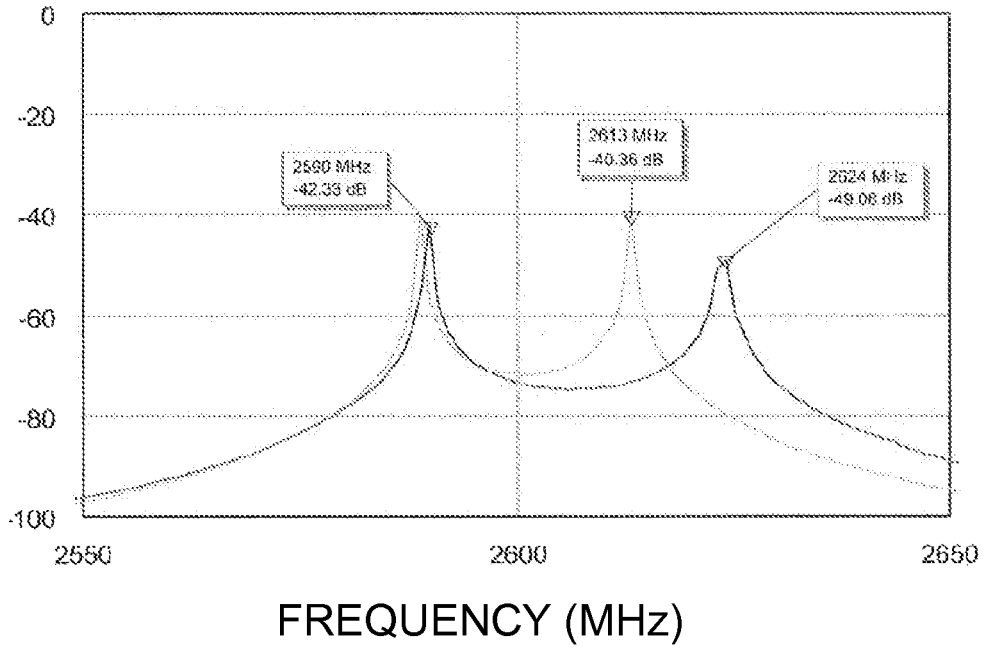
FIG. 5 shows changes in strength of the coupling of a resonator filter according to the invention as a function of the frequency.

FIG. 5 shows an example of a measured changed in the bandwidth with an arrangement according to the invention. The vertical axis shows the strength of the coupling in decibels and the horizontal axis shows the frequency. The light curve shows the situation when the adjustment piece is in the minimum position for the coupling. The distance of the resonance peaks is about 23 MHz. The dark curve on the other hand shows the situation when the adjustment piece is in the maximum position for the coupling. The distance of the resonance peaks is in this case about 34 MHz. The distance of the resonance peaks can thus be adjusted by over 10 MHz. With the arrangement according to the invention the adjustment is also quite linear and thus easily controlled.

Figure 6:
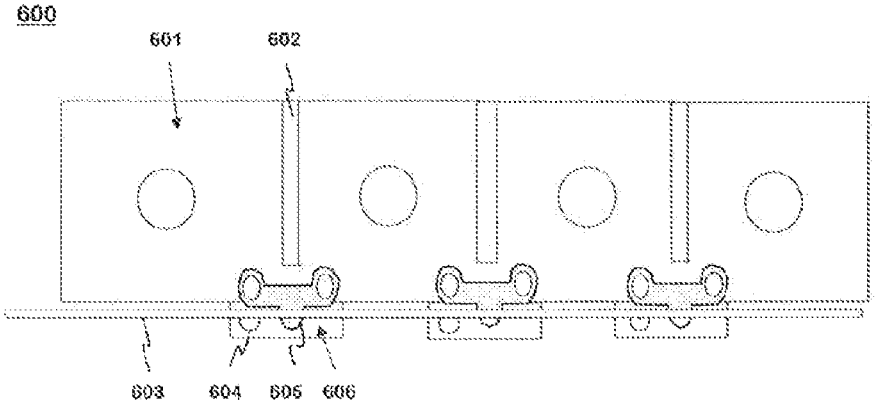
FIG. 6 shows a third example of a resonator filter according to the invention seen from above.

FIG. 6 shows a third example of a resonator filter 600 according to the invention seen from above. The filter has four subsequent resonators 601, which are separated by partitions 602. A coupling space 606 has been made in the filter wall by each partition. Between subsequent resonators there is an inductive coupling piece 605, the different ends of which are in different resonators. The coupling spaces have adjustment pieces, which are attached to a maneuvering member 603.

Because all the adjustment pieces are attached to the same maneuvering member, all the adjustment pieces and simultaneously the couplings caused by all the inductive coupling pieces can at the same time be adjusted by moving it. This speeds up the adjustment significantly in comparison to a situation where each coupling would be adjusted separately. It must be noted that the properties of each coupling piece and adjustment piece, such as the dimensions or electric properties, may be different, even if they are arranged to be adjusted simultaneously.

The definitions "horizontal", "vertical", "lower", "upper", "downwards", "upwards" and "from above" and corresponding directions in this description and claims refer to the position of the filter, where the lid and the bottom of the filter casing are in a horizontal position, the lid being higher, and these definitions have nothing to do with the use position of the filter.

Some advantageous embodiments according to the invention have been described above. The invention is not limited to the solutions described above, but the inventive idea can be applied in numerous ways within the scope of the claims.

What is claimed is:

1. An adjustable resonator filter, which has a casing made up of a bottom, walls and a lid, wherein the casing functions as a ground for a transmission path and wherein the casing is divided into a plurality of resonator cavities by one or more conductive partitions, wherein there is a coupling opening in each of the one or more conductive partitions, wherein there is a coupling space in the casing adjacent to at least one of the one or more conductive partitions and positioned away from the coupling opening of the at least one of the one or more conductive partitions, wherein the coupling space is open into adjacent resonator cavities separated by the one of the one or more conductive partitions, wherein the adjustable resonator filter has at least one inductive coupling member, wherein the at least one inductive coupling member is arranged to extend through said coupling space into the adjacent resonator cavities and said at least one inductive coupling member is in electric contact with the casing in at least in one of the adjacent resonator cavities, and in said coupling space there is a moveable conductive adjustment piece, wherein the moveable conductive adjustment piece has a minimum position and a maximum position, wherein the moveable conductive adjustment piece is adjacent to the at least one inductive coupling member and an electric effect of the moveable conductive adjustment piece on the inductive coupling member is at a maximum when the moveable conductive adjustment piece is in the maximum position thereof, and wherein the moveable conductive adjustment piece is positioned away from the inductive coupling member and the electric effect of the moveable conductive adjustment piece on the inductive coupling member is at a minimum when the moveable conductive adjustment pieces is in the minimum position thereof.

2. The adjustable resonator filter according to claim 1, wherein the coupling space is located in one of the walls of the casing and extends substantially from the bottom to the lid of the casing.

3. The adjustable resonator filter according to claim 1, wherein the inductive coupling member is substantially electrically separate from the casing walls of the coupling space.

4. The adjustable resonator filter according to claim 1, wherein the moveable conductive adjustment piece is arranged to be moveable substantially in a first direction of the adjustable resonator filter.

5. The adjustable resonator filter according to claim 1, wherein the a distance from the top of the moveable conductive adjustment piece to the at least one inductive coupling member is adjustable.

6. The adjustable resonator filter according to claim 1, wherein the inductive coupling member has a first end, a second end and a protruding part located between the first end and the second end and the protruding part extending into the coupling space.

7. The adjustable resonator filter according to claim 6, wherein the shape of the protruding part is substantially the same as a shape of a part of the moveable conductive adjustment piece.

8. The adjustable resonator filter according to claim 1, wherein the moveable conductive adjustment piece has a maneuvering arrangement, in which the location of the moveable conductive adjustment piece can be altered from outside the adjustable resonator filter.

9. The adjustable resonator filter according to claim 8, wherein the moveable conductive adjustment piece further includes a plurality of moveable conductive adjustment pieces, wherein the maneuvering arrangement is arranged to move simultaneously the plurality of moveable conductive adjustment pieces of the adjustable resonator filter.

10. The adjustable resonator filter according to claim 1, wherein the at least one inductive coupling member has a first end attached to one of the walls of the casing and the second end is positioned in one of the adjacent resonator cavities.

11. The adjustable resonator filter according to claim 10, wherein the second end of the inductive coupling member is not attached to the one wall of the casing.

* * * * *